United States Patent [19]

Nicholas et al.

[11] Patent Number: 4,824,384

[45] Date of Patent: Apr. 25, 1989

[54] ELECTRICAL CABLE CONNECTOR AND METHOD OF USE

[75] Inventors: Vincent Nicholas, Spring Hill; Paul P. Siwinski, Seminole, both of Fla.

[73] Assignee: AMP Incorporated, Harrisburg, Pa.

[21] Appl. No.: 136,785

[22] Filed: Dec. 22, 1987

Related U.S. Application Data

[63] Continuation-in-part of Ser. No. 23,760, Mar. 9, 1987, Pat. No. 4,747,787.

[51] Int. Cl.[4] ..... H01R 13/650

[52] U.S. Cl. ..... 439/108; 439/496; 439/497

[58] Field of Search ..... 439/92, 98, 99, 101, 439/108, 494–497, 499, 874, 875

[56] References Cited

U.S. PATENT DOCUMENTS

| | | | |
|---|---|---|---|
| 4,040,704 | 8/1977 | Huber . | |
| 4,040,705 | 8/1977 | Huber . | |
| 4,094,564 | 6/1978 | Cacolici . | |
| 4,094,566 | 6/1978 | Dola et al. . | |
| 4,140,360 | 2/1979 | Huber . | |
| 4,163,598 | 8/1979 | Bianchi et al. . | |
| 4,181,384 | 1/1980 | Dola et al. . | |
| 4,260,209 | 4/1981 | Zell et al. . | |
| 4,269,466 | 5/1981 | Huber . | |
| 4,352,531 | 10/1982 | Gutter . | |
| 4,367,909 | 1/1983 | Shatto, Jr. et al. . | |
| 4,420,201 | 12/1983 | Stephenson . | |
| 4,451,099 | 5/1984 | Bricker, Jr. et al. . | |
| 4,491,381 | 1/1985 | Hamsher, Jr. et al. . | |
| 4,602,831 | 7/1986 | Lockard . | |
| 4,616,893 | 10/1986 | Feldman . | |
| 4,747,787 | 5/1988 | Siwinski | 439/108 |

OTHER PUBLICATIONS

AMP Catalog No. 73-177, (Rev.8-86) "AMP-Latch Ribbon Cable Connector System", pp. 74–78.

*Primary Examiner*—Eugene R. LaRoche
*Assistant Examiner*—Robert J. Pascal
*Attorney, Agent, or Firm*—Robert W. Pitts

[57] ABSTRACT

A connector adapted to couple stripped electrically conductive wires of a flat cable with the traces of a printed circuit board through a mating connector upstanding from the printed circuit board. The connector comprises a housing formed with a longitudinal central slot adapted to receive an electrically conductive ground bus. The upper end of the bus is adapted to retain stripped ground wires of the flat cable by crimping and soldering. The lower end of the bus is adapted to be received within the mating connector. A plurality of parallel apertures are formed in the housing on opposite sides of the bus to receive signal contact, the upper ends of which are adapted to retain stripped signal wires of the flat cable by soldering. The lower ends of the signal contacts are adapted to be received within the mating connector. The connector also includes front and rear cover halves couplable between the housing and the printed circuit board and adapted to receive and support therebetween the flat cable above its stripped wires. Also disclosed is the method of using the connector.

22 Claims, 7 Drawing Sheets

12
10
64
80
76
62
66
78
148
150
114
154
82
124
154
126
54
36
34
56
14
156
70
68
30
32
28
156
16
38

ELECTRICAL CABLE CONNECTOR AND METHOD OF USE

BACKGROUND OF THE INVENTION

This application is a continuation-in-part of U.S. patent application Ser. No. 023,760 filed Mar. 9, 1987 and now U.S. Pat. No. 4,747,787 issued May 31, 1988.

FIELD OF THE INVENTION

This invention relates to a connector for a multiconductor cable and, more particularly, to a connector for coupling electrically conductive wires of a multiconductor flat transmission cable to traces of a printed circuit board and to a method of using such connector.

DESCRIPTION OF THE PRIOR ART

The development of new electrical cables in which a large number of wires are encapsulated in a flat insulating web has produced significant advantages in computers, telecommunication devices, and the electronic industry generally. These cables are manufactured with conductors formed as fine parallel wires, as small as 0.030 inches in diameter, located on closely spaced centerlines. They may be used for transmitting electrical signals.

Along with the obvious advantages of size reduction and ease of handling the flat cables per se, such flat cables also present certain disadvantages, both mechanically and electrically. From the mechanical standpoint, the fineness of the wires and the closeness of their spacing generally increase wire handling difficulties during the coupling of the individual wires to other electrical components such as connectors. Further, since their centerline spacings are unusually small, they may not necessarily coincide with the standard centerline spacings for commonly used electrical elements, thus creating interconnection problems. The development of even smaller cables with finer, more closely spaced wires, further aggravates these mechanical problems in addition to complicating the design of connectors compatible with such further miniaturized cables.

From the electrical standpoint, particularly when flat cables are used for signal transmission purposes, the closeness of wire centerlines dictates their positioning at a specific, precise, constant distance for a particular application if the accurate transmission of signals is to be accomplished. Of equal importance, when flat, multiwire cables are terminated with connectors, such connectors must be designed for controlling the characteristic impedance of the transmitted signals while matching it to the cable as well as the electronic devices being coupled.

The prior art discloses many types of connectors for coupling flat cables to a mating connector and electronic device. Note, for example, U.S. Pat. No. 4,094,566 to Dola, et al; U.S. Pat. No. 4,181,384 also to Dola, et al; and U.S. Pat. No. 4,367,909 to Shatto, et al. The instant invention, however discloses a connector or method of use having sufficient utility for its convenient use with flat multiconductor cables formed with conductive wires of 0.008 inches in diameter, several times smaller than those previously employed. Such significantly reduced wire diameters will allow for the proportionate reduction in the spacing between centerlines to 0.0125 inches along with a proportionate increase in the number of wires per cable to 81 wires per linear inch. While U.S. Pat. No. 4,616,893 discloses a connector with controlled characteristic impedance between printed circuit boards, no prior art teaching or suggestion of releasable connectors for flat, multi-wire, signal transmission cables with controlled impedance characteristics matching the cable, the mating connector and the electronic devices to be coupled is known.

None of these prior art patents teaches or suggests the accurate, efficient, convenient, and economical connector and method as described herein. Known methods and connectors are simply lacking in one regard or another.

As illustrated by the great number of prior patents, efforts are continuously being made in an attempt to more efficiently connect electrical elements of ever decreasing size. None of these prior art efforts, however, suggest the present inventive combination of method steps and components elements arranged and configured for coupling electrical elements as disclosed and claimed herein. Prior methods and connectors do not provide the benefits attendant with the connector and method of the present invention. The present invention achieves its purposes, objectives and advantages over the prior art methods and devices through a new, useful and unobvious combination of method steps and component elements, through the use of a minimum number of functioning parts, at a reduction in cost to manufacture and operate, and through the utilization of only readily available materials and conventional components.

These objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. For the purposes of summarizing the invention, the invention may be incorporated into a connector adapter to couple stripped electrically conductive wires of a flat multiconductor transmission cable with the traces of a printed circuit board through a mating connector upstanding from the printed circuit board. The connector comprises a housing formed with a longitudinal central slot, the slot being adapted to receive an elongated electrically conductive ground bus, the upper end of which is adapted to receive stripped ground wires of the flat cable and the lower end of which is adapted to be received within the mating connector. The ground bus is shiftable from a first to a second position within the slot. The housing has a longitudinal central plane extending through the slot and the bus. A plurality of parallel apertures are formed in the housing on opposite sides of the central slot. The apertures are adapted to receive signal contacts, the upper ends of which are adapted to receive stripped signal wires of the flat cable and the lower ends of which are adapted to be received within the mating connector. The housing also has downwardly extending legs defining an opening for receving the mating connector. The connector also comprises front and rear cover halves couplable between the housing and the printed circuit board and adapted to receive and support therebetween the flat multiconductor transmission cable above its stripped wires.

Each cover half includes a downwardly projecting first leg with a horizontal, upwardly facing ledge. The connector further includes a pair of side latches couplable with the printed circuit board. Each side latch has an upwardly projecting leg with t horizontal, downwardly facing ledge for receiving on the upwardly facing ledges of the cover halves for coupling the cover halves and the housing with respect to the side latches and the printed circuit board. Each cover half has a downwardly projecting second leg, the second legs being located on opposite sides of the longitudinal central plane of the connector and interiorly of the first legs with each second leg having a lower surface positionable upon an internal upper surface of the housing. The connector further includes a space between each first leg and its adjacent second leg to allow each first leg to be moved interiorly toward the second legs for the coupling and uncoupling of the cover halves and the housing with respect to the side latches and printed circuit board. The housing has cut out portions on its front and rear faces and an external upper surface for the receipt of the cover halves. The lower extents of each second leg have face projections extending longitudinally toward the ends of the housing receivable in corresponding face recesses in the housing to preclude upward movement of the cover halves when positioned within the housing. The ends of each cover half have end projections extending longitudinally toward the ends of the housing receivable in corresponding end recesses in the housing to preclude lateral movement of the cover halves when positioned within the housing. The connector further includes internal recesses in the cover halves facing the longitudinal central plane of the connector for receiving the upper portions of the signal contacts and the ground bus as well as the stripped wires of the flat cable. The connector further includes means associated with the side latches to couple the side latches to a printed circuit board. The last mentioned means includes a button downwardly extending from each side latch, each button having a cut out to facilitate its contraction and expansion and consequently, its insertion into, its retention in, and its removal from, a hole in a printed circuit board.

The invention may further be incorporated into a combination for coupling wires of a flat cable with an electrical connector. The combination comprises signal contacts within the connector. Each signal contact has a downwardly extending U-shaped slot, the bights of the slots having semicircular cross-sectional configurations about parallel horizontal axes with a common first diameter. The combination also comprises signal wires extending parallel with each other in the plane of a flat cable. The signal wires have circular cross-sectional configurations with a common second diameter less than the first diameter. The signal wires have stripped free ends with a bend in each signal wire adjacent to its free end of less than 90 degrees from an original vertical orientation whereby the bent portion of each signal wire may contact the bight of one of the signal contacts adjacent to its end remote from the plane of the flat cable. The combination also comprises material coupling each signal wire and its associated signal contact.

The soldering material encompasses at least about 270 degrees of the cross-sectional area of each signal wire. The bend is about 70 degrees. The signal contact are locate on opposite sides of the plane of the flat cable and the bends of some of the signal wires are toward the signal contacts on one side of the plane and the bends of others of the signal wires are toward the signal contacts on the other side of the plane. The combination further includes ground wires extending downwardly from the flat cable between the signal wires and a ground bus in the plane of the flat cable for receiving the ground wires. The ground bus is formed as an electrically conductive U-shaped member with upwardly facing flanged ends. The upper extent of the U-shaped member is adapted to be crimped over the downwardly extending ground wires.

Further, the invention may be incorporated in a connector releasably couplable with mating connector means. The connector includes a housing fabricated of an electrically insulating material with an opening formed to receive, support, and provide strain relief to the stripped free end of a flat, multi-wire, signal transmission cable. The connector also includes a plurality of spaced, parallel, electrically conductive signal contacts supported by the housing in a first plane and having their first ends within the housing and adapted to receive some wires of the received cable for signal transmission purposes, the signal contacts having second ends releasably couplable with the mating connector means. The connector also includes a blade-like ground bus supported by the housing having a first end within the housing and adapted to receive others of the wires of the received cable for grounding purposes. The ground bus has a second and releasably couplable with the mating connector means, the ground bus being in a second plane parallel with, but offset from, the first plane at a predetermined distance for controlling the impedance characteristics of the transmitted signals through the connector from the first ends of the ground bus and signal contact to the second ends of the signal contacts and ground bus. The signal contacts are located in two parallel first planes on opposite sides of the ground bus and the second plane with the first planes being equally spaced from the second plane. The ground bus is adapted to receive every other wire of the cable for grounding purposes and the wires of the cable not received by the ground bus are adapted to be received by signal contact. The second ends of the ground bus and signal contacts extend beyond the housing for insertion into the mating connector means. The connector further includes solder means to couple signal contacts to signal transmitting wires.

In addition, the invention may further be incorporated in a method for coupling electrically conductive wires of a flat cable with signal contacts of a connector. The method includes the steps of (1) supporting signal contacts within a connector, each signal contact having a downwardly extending U-shaped slot, the bights of the slots having semicircular cross-sectional configurations about parallel horizontal axes with a common first diameter; (2) providing signal wires extending parallel with each other in the plane of a flat cable, the signal wires having circular cross-sectional configurations with a common second diameter less than the first diameter, the signal wires having stripped free ends; (3) bending each signal wire adjacent to its free end less than 90 degrees from an original vertical orientation; (4) supporting, within the connector, the wires with the bent portions contacting the bights of the signal contacts adjacent to their ends remote from the plane of the flat cable; and (5) coupling the signal wires to the signal contacts.

The coupling is effected by soldering material deposited into the signal contacts by a technique selected from the class of depositing techniques including plating, printing, silkscreening, dipping and inlaying. The soldering material is preferably deposited by plating the bight of the slot. The soldering material is preferably caused to liquify through reflow soldering. The soldering material is liquified by a techniques selected from the class of liquifying techniques including radio frequency, resistance, laser or vapor phase. The soldering material is preferably liquified by radio frequency. The ground bus is formed as a U-shaped metallic member with upwardly facing flanged ends. The method further includes the step of crimping the U-shaped member over the downwardly projecting ground wires. The U-shaped ground bus is shiftable within a housing slot so that the ground wires can be crimped to the U-shaped ground bus, and subsequent movement of the ground bus brings the signal wires into proximity to the signal contacts.

Lastly, the invention may be incorporated in a method of coupling an electrically conductive wire with a signal contact of a connector. The method includes the step of supporting a signal contact within a connector, the signal contact having a downwardly extending U-shaped slot, the bight of the slot having semicircular cross-sectional configuration with a first diameter, The method includes the further step of providing a signal wire, the signal wire having a circular cross-sectional configuration with a second diameter not greater than the first diameter, the signal wire having a stripped free end. The method includes the step of bending the signal wire adjacent to its free end less than 90 degrees from an original orientation. Further, the method includes the steps of supporting, within the connector, the wire with the bent portion contacting the bight of the signal contact adjacent to one end and adhering the signal wire to the signal contact.

The foregoing has outline rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiment disclosed herein may be readily utilized as a basis for modifying or designing other methods and appparatus for carrying out the same purposes of the present invention. It should also be realized by those skilled in the art that such equivalent methods and apparatus do not depart from the spirit and scope of the present invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which:

FIG. 3 is a sectional view of the apparatus shown in FIG. 2 taken through the center of the connector, mating connector and flat cable.

FIG. 5 is a sectional view showing the ground wires as crimped to the ground bus.

DETAILED DESCRIPTION OF THE PREFERRED EMBODIMENT

Figure 1:
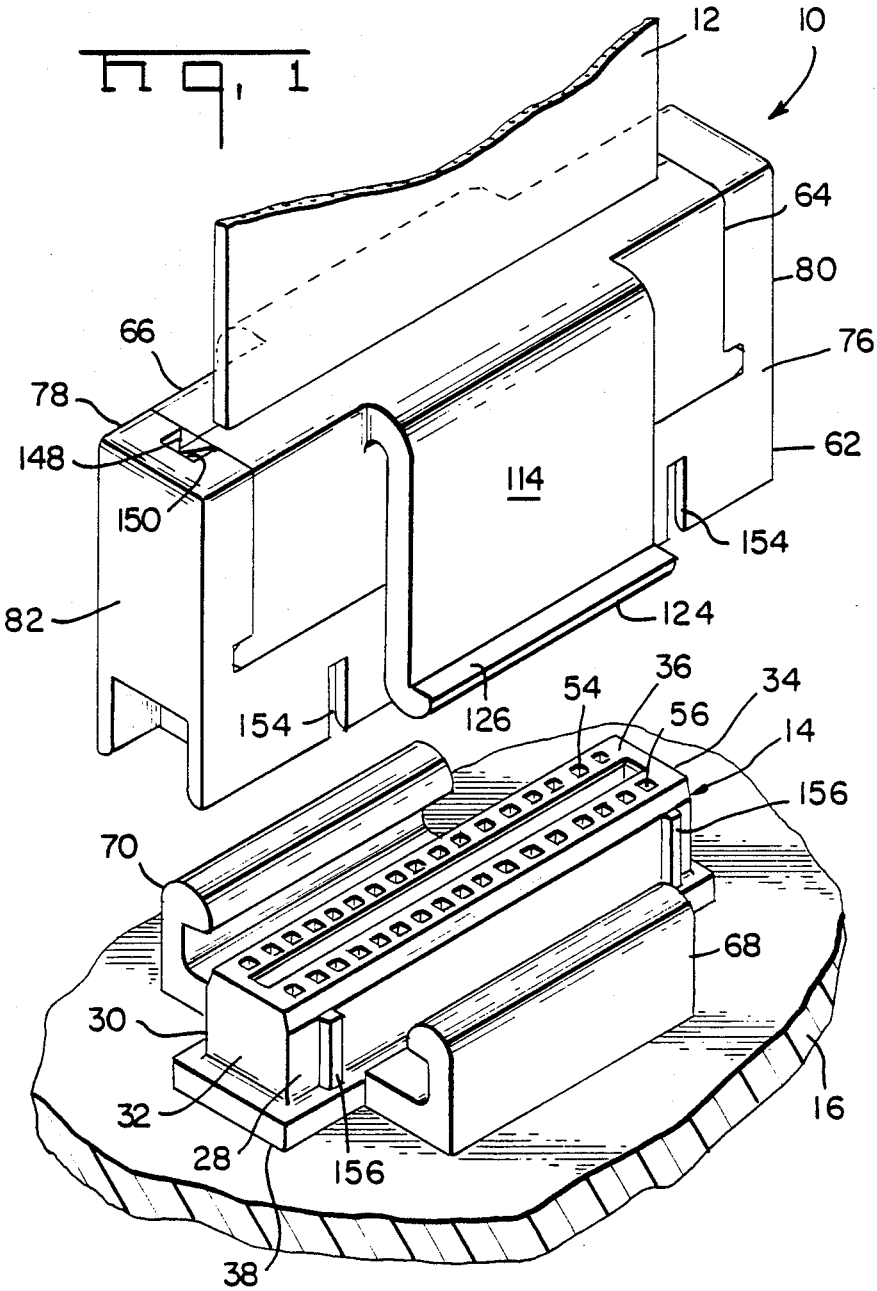
FIG. 1 is a perspective illustration of the present inventive connector supporting a flat cable and in a position to be coupled with an associated mating connector.
Figure 2:
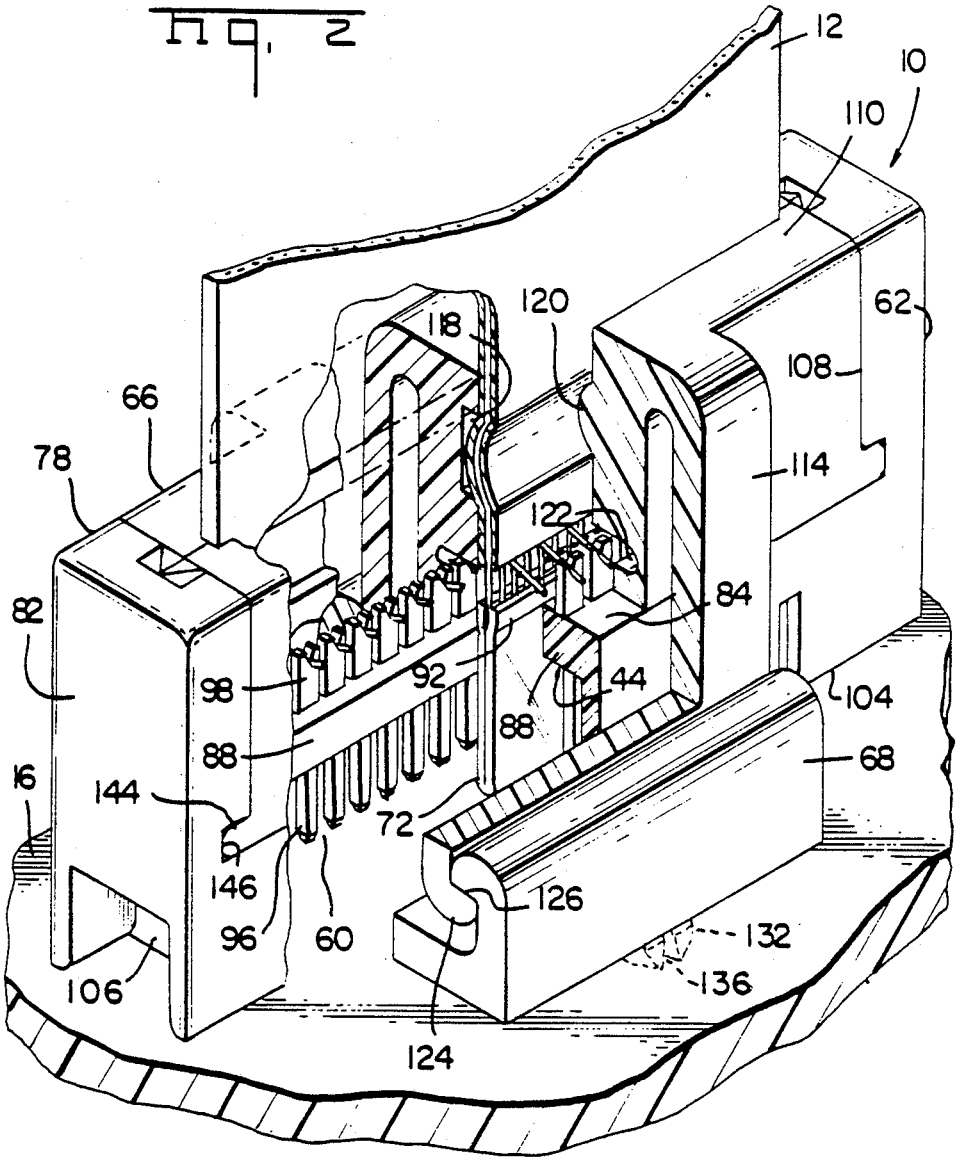
FIG. 2 is a perspective illustration of the present inventive connector as shown in FIG. 1, but with the connector coupled to its mating associated connector and with parts broken away to show certain internal constructions.
Figure 7:
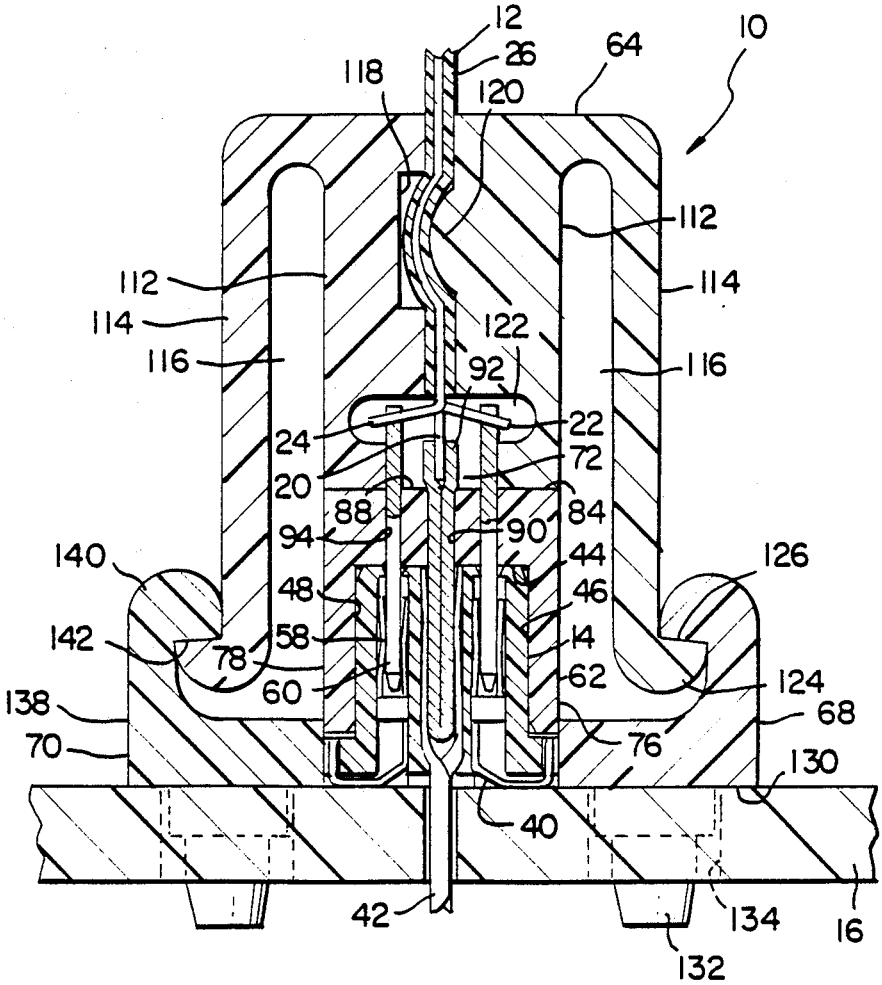
FIG. 7 is a perspective illustration of two signal contact wires and their associated signal contacts and also showing the soldering material effecting the coupling therebetween.

Shown in the Figures, with particular reference to FIGS. 1 and 2, is an electrical connector 10 embodying the principles of the present invention with parts removed to show certain internal constructions. The connector is shown in combination with the flat multiconductor signal transmission cable 12 and a mating connector 14 secured to a printed circuit board 16. The flat cable is formed as a flat member fabricated of electrically insulative material having a plurality of fine, closely spaced electrical conductive wires 20, 22 and 24 embedded therein. The wires are positioned parallel, one with respect to the other, with the insulative material 26 separating the wires. The ends of the wires within the connector are stripped for appropriate coupling with their associated contacts.

Also shown in FIGS. 1, 2 and 3 is the printed circuit board 16 supporting on its upper surface a mating connector 14 for receiving the connector 10 whereby discrete elements of the mating connector and printed circuit board may interconnect with discrete conductive elements of the cable within the connector. The mating connector 14 is formed with front and rear faces 28 and 30, end faces 32 and 34, and top and bottom surfaces 36 and 38. The bottom surface 38 is supported on the printed circuit board 16. Interconnecting contact elements 40 are located within the mating connector for attachment to traces on the printed circuit board. The top surface 36 and faces 28, 30, 32 and 34 of the mating connector receive a lower surface 44 and interior faces 46 and 48 of the principal electrical connector 10. The mating connector 14 also is provided with apertures 54 and 56 extending between the top and bottom surfaces 36 and 38 with electrically conductive receptacle contacts 58 for receiving the contact 60 of the connector 10 for conducting current between the wires 20, 22 and 24 of the flat cable 12 and the traces of the printed circuit board 16.

The connector 10 itself is formed of a plurality of connectable component elements formed of an electrically insulative plastic material. The preferred material is Ultem 1000. Ultem 1000 is a trademark of the General Electric Company. These connectable component elements include the housing 62 adapted to be supported upon the mating connector 14 as well as as front cover half 64 and rear cover half 66 adapted to be received within the housing for securing the flat cable with respect to the housing. The connector 10 also includes front and back side latches 68 and 70 for securing the cover halves 64 and 66, and consequently the connector 10 to the printed circuit board 16. The housing 62 is also configured and adapted to support electrically conductive signal contacts 60 and an electrically conductive ground bus 72 in proper position with respect to the flat cable 12 and its conductive wires and to provide electrical connections with the electrical conductive segments of the mating connector 14.

As used herein, the terms front and rear, upper and lower, horizontal and vertical, and the like are used for descriptive purposes only. It should be readily appreciated that the connector of the present invention could be used in any vertical, horizontal, or angular orientation without departing from the spirit and scope of the invention. Such descriptive language herein should, in no way, be construed as limiting the invention in any manner. In addition, when the flat cable is received by the connector 10, the majority of its extent lies in a plane which is the longitudinal central plane of the connector 10, mating connector 14 and ground bus 72. The terms interior and exterior and the like are intended to be construed with respect to this longitudinal central plane.

Figure 6:
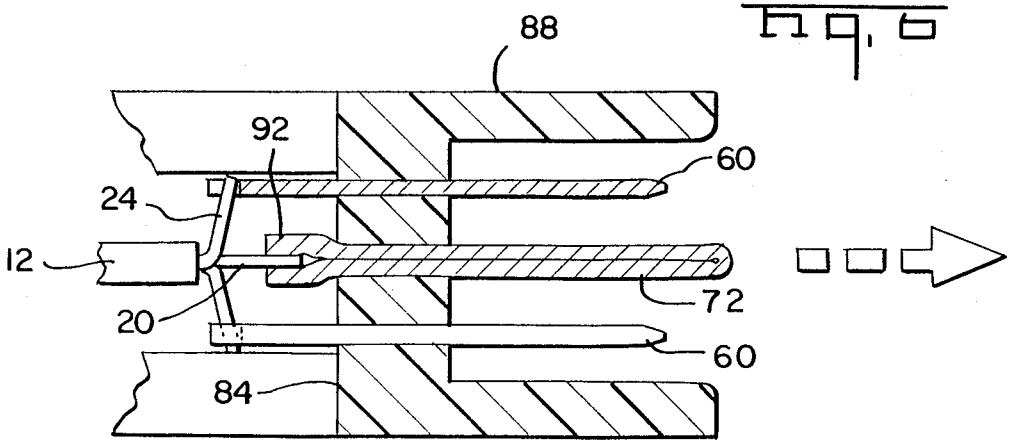
FIG. 6 is a sectional view similar to FIG. 5 showing the signal wires being brought into proximity of the signal contacts by movement of the ground bus.
Figure 7:
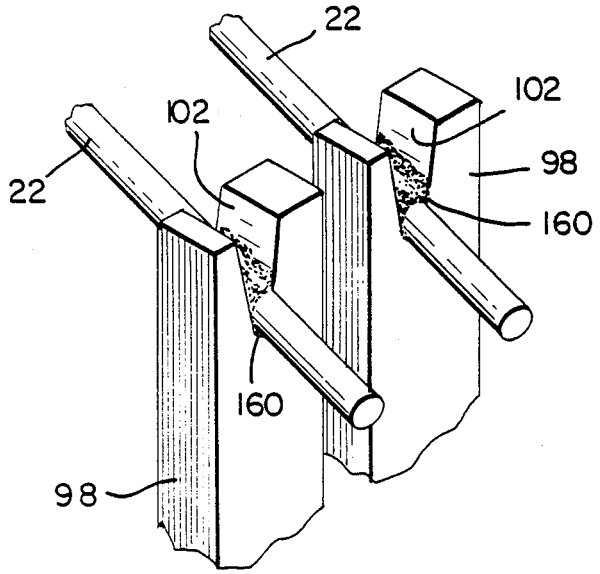
Figure 8:
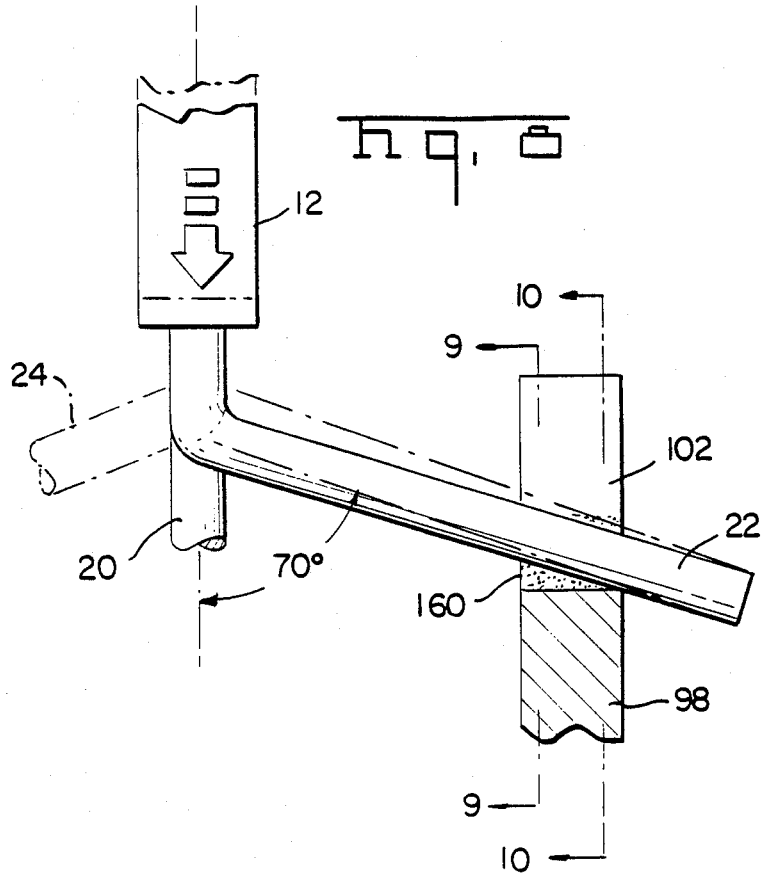
FIG. 8 is a sectional view of a ribbon connector and some of its wires coupled to a signal contact with solder material therebetween, a signal wire being shown in both an initial position and a final position.
Figure 9:
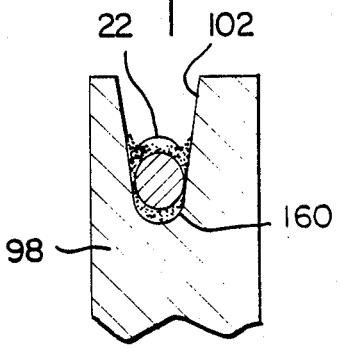
FIGS. 9 and 10 are sectional views of a signal contact and signal wire with solder material therebetween taken along lines 9—9 and 10—10, respectively, of FIG. 8. Similar reference numerals refer to similar parts throughout the several Figures.
Figure 10:
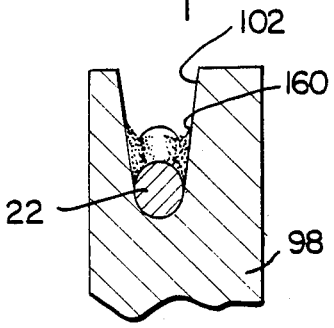

With particular reference to FIGS. 1, 2 and 3, the housing 62 is formed of a block-like member with front and rear faces 76 and 78, end faces 80 and 82, and a lower surface 44 and an upper internal surface 84 fabricated into a unitary component member as by molding. The housing includes inwardly projecting shelf-like blocks 88, the upper surfaces of which constitute the upper internal surface 84 of the housing. These blocks extend inwardly toward the longitudinal central plane of the connector and toward each other to form a central slot 90 of such size as to receive a ground contact or bus 72. The bus is a blade-like electrically conductive member formed of an electrically conductive material, preferably metal. It is formed in a tight U-shaped configuration with its free edges 92 extending upwardly and outwardly, flared to a limited degree, for assisting in locating and receiving ground wires 20 of the flat cable 12. The lower portion of the ground bus 72 is adapted to be received downwardly into the central slot 90 of the housing and to mechanically and electrically receive selected conductive wires 20 of the flat cable, specifically, those wires of the cable intermediate the signal wires which function as electrical grounds. The bus 72 is shiftable within slot 90 from the position shown in FIG. 5 to the position shown in FIG. 6.

Also located within the blocks 88 of the housing 62 are vertical apertures 94 adapted to receive signal contact 60. The signal contacts are formed of an electrically conductive material, preferably metal. They include posts 96 of a rectangular cross-sectional configuration over the majority of their lower lengths. Their upper extents 98 are rectangular in cross-section but enlarged with respect to their lower extents for being received by, and supported upon, the upper surfaces 84 of the blocks 88. Their upper edges are provided with notches 102, perpendicular with respect to the longitudinal central plane of the connector. Each notch has a U-shaped or semicircular lower extent for receiving a signal wire 22 or 24 of the flat cable. The lower stripped ends of the ground contact wires 20 and signal contact wires 22 and 24 are thus adapted to be received respectively by the ground contact bus 72 and signal contact 60 for mechanically and electrically coupling the wires of the cable with the electrically conductive connectors of the mating connector and, hence, to the traces of the printed circuit board, all in a particular predetermined orientation.

Figure 4A:
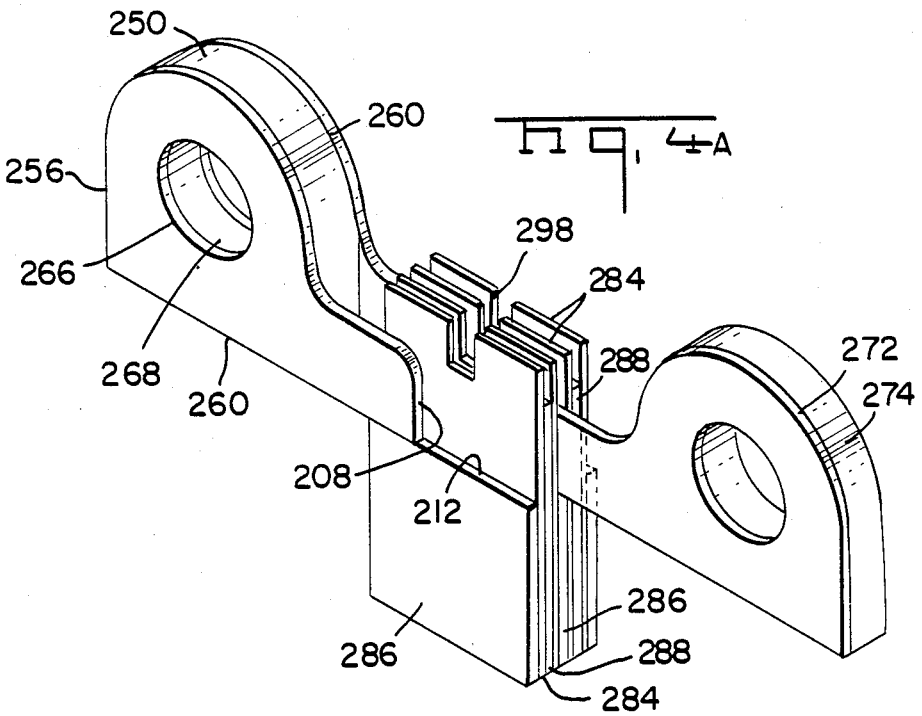
FIG. 4A shows a bending fixture for deploying or bending signal wires, on the stripped end of a flat cable, relative to ground wires in the manner shown in FIG. 4B.
Figure 4B:
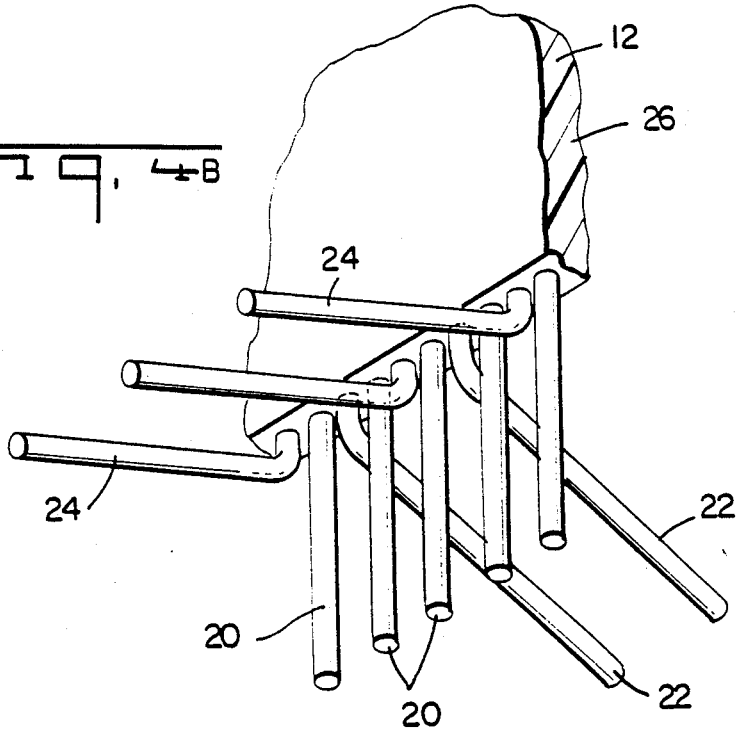
Figure 7:
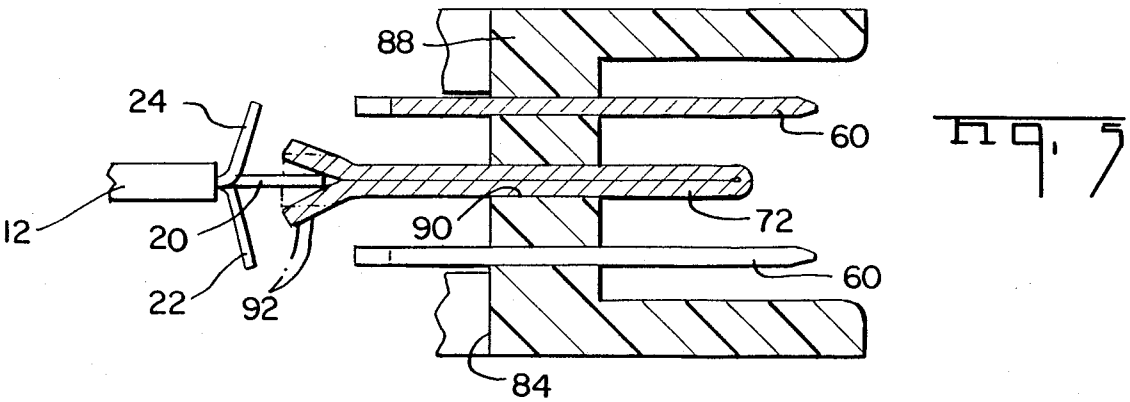

The signal wires 22, 24 and the ground wires 20 can be mechanically and electrically secured to associated signal contacts 60 and ground bus 72 by first bending the signal wires of a stripped cable 12 in the manner shown in FIG. 4B. A bending fixture suitable for precisely bending the signal wires 22, 24 is illustrated in FIG. 4A. Only a portion of the bending fixture is shown in FIG. 4A and it will be understood that this fixture constitutes only one apparatus for deploying the signal wires 22, 24. This fixture includes a number of relatively tall positioning shims 84, each having a notch 298 with a width substantially equal to the thickness of flat cable 12. Notches 298 in the plurality of positioning shims 284 are aligned. Positioning shims 284 are separated by signal wire shims 286 and ground wire shims 288. Each ground wire shim 288 has a ground wire notch (not shown), aligned with notches 298, and having a greater depth. The upper edge 212 of signal wire shims 286 are lower than notches 298. A plurality of bending fingers 260, 272 are aligned with the channels formed between tall positioning shims 284 and above signal wire shims 286. No bending fingers are aligned with ground wire shims 288. Bending fingers 260, 272 are staggered and are shiftable towards and away from each other. When the stripped end of a cable 12 is positioned with the insulation in the notches 298 and the wires 20, 22, 24 extending between positioning shims 284, inward movement of bending fingers 260, 272 will bend or deploy the signal wires 22, 24 in the manner shown in FIG. 4B.

With the wires deployed, as shown in FIG. 4B, the ground wires 20 can be crimped between the flared ends 92 of ground bus 72 in the manner shown in FIG. 5. Note that the flared ends 92 are accessible from the sides with the ground bus in the position shown in FIG. 5. Once the ground wires 20 have been crimped to the ground bus 72, the ground bus is shifted within slot 90 from the position shown in FIG. 5 to that shown in FIG. 6. Movement of the ground bus 72, to which the cable 12 is now attached will bring the bent signal wires 22, 24 into proximity with the signal contacts 60.

The front and rear faces 76 and 78 of the housing are formed with downwardly projecting legs 104. Similarly, downwardly projecting legs 106 are formed in proximity to the ends of the housing. These downwardly projecting legs extend generally peripherally around the housing and are arranged to be slid over the front and rear faces 28 and 30 and ends 32 and 34 of the mating connector 14.

Portions of the top external surface and faces of the housing are formed as cutaways 108 so as to receive the front and rear cover halves. The cover halves are similarly shaped, each with an upper portion 110 positionable proximate the upper external surface of the housing and with two downwardly extending pair of parallel legs 112 and 114. The interior legs 112 are the shorter legs with their interior faces located closer to the longitudinal central plane of the connector. Their lower surfaces are supported by an upper internal surface of the housing. The exterior legs 114 are the longer legs with their interior surfaces spaced from the interior legs to create spaces 116 therebetween.

The front and back cover halves are essentially symmetrical with respect to the longitudinal central plane of the connector except for a strain relief recess 118 and a mating strain relief projection 120 adjacent to their upper interior surfaces for receiving and holding the cable 12 to preclude its movement from the connector during operation and use as might occur through inadvertent pulling. Beneath the strain relief elements of the cover halves are additional recesses 122 for accommodating the upper extents of the signal contact 60 and bus 72 and the lower stripped ends of the wires of the flat cable. In operation and use, the end of the flat transmission cable supported by the connector 10 is stripped to such an extent that its non-stripped portion will be contacted by the strain relief elements of the cover halves for providing the desired restraint from movement. The area of the flat cable beneath the strain relief elements will be stripped to such an extent that the stripped ends are located within the additional recesses 122 of the cover halves.

The lower ends of the exterior legs are formed with projections 124 extending exteriorly away from the longitudinal central plane of the housing. The projections include essentially horizontal, upwardly facing, ledges 126 which are employed for fixedly positioning the housing with respect to the printed circuit board during operation and use. Between the interior and exterior legs are the upwardly extending spaces 116 to allow for a limited degree of movement of the exterior legs which, due to their resiliency, accommodate the attachment and removal of the connector from the printed circuit board.

The last component elements of the connector are two similarly configured side latches 68 and 70. The side latches have lower surfaces 130 supported upon the upper surface of the printed circuit board 16. Formed on the lower surface of each side latch is a downwardly projecting attachment button 132 to be received by apertures 134 in the printed circuit board to which the connector is to be secured. At a central extent, each button 132 is provided with an enlarged area with an upwardly facing abutment surface and an axial cutout 136 whereby the lower end of the buttons may be contracted, forced through holes in the printed circuit board, and released to provide a secure mechanical attachment to the printed circuit board for the side latches and hence for the connector and flat cable. Contraction of a button 132 at its cutout 136 will allow removal of its side latch from the printed circuit board.

Upwardly extending from the base portions of the side latches are legs 138 formed with projections 140 extending inwardly toward the longitudinal centerline of the housing. The projections include downwardly facing, essentially horizontal ledges 142 which are employed to receive and hold the upwardly facing ledges 126 of the cover halves. The positioning of the cover halves and housing over the mating connector will allow the cover halves to be secured with respect to the side latches for holding the connector in place with respect to the mating connector and printed circuit board.

The lower extents of each of the first or interior legs of each cover half have face projections 144 in the plane of their leg extending longitudinally away from each other and toward the ends of the housing. These projections, a total of four in number, are received in correspondingly shaped face recesses 146 in the front and rear faces of the housing. When coupled, the projections and recesses preclude upward and downward movement of the cover halves with respect to the housing. Similarly, the ends of each of the cover halves have outwardly extending end projections 148, four in number, facing away from each other and toward the ends of the housing. These projections are receivable in correspondingly shaped end recesses 150 in the housing. When the cover halves are coupled to the housing, these projections and recesses will preclude lateral movement of the cover halves in a horizontal plane with respect to the housing.

The coupling of the front and rear cover halves 64 and 66 with respect to the connector housing 62 is effected by simply holding the cover halves parallel with each other adjacent to the flat cable after the stripped cable ends have been coupled to the signal contacts 60 and the ground bus 72. While maintaining this parallel relationship, the halves are moved either simultaneously or sequentially toward the flat cable 12. The halves with their end projections 148 will readily snap into the end recesses 150 for proper operational positioning of the cover halves with respect to the housing 62. Removal of the cover halves involves urging the upper portions of the housing outwardly away from each other in the plane of the longitudinal central plane. This action allows the end projections 148 to clear the end recesses 150 as the halves are pulled away from the flat cable and housing 62 by a motion reversed with respect to the motion which effected their coupling.

The front face 28 of the mating connector 14 is provided with two upwardly extending spaced parallel plugs 156. Similarly, the front face of the connector housing 62 is formed with two downwardly extending spaced parallel slots 154. The plugs and slots are equally spaced and of substantially the same width to allow the mating of the connector housing 62 with the mating connector. These plugs and slots are located on one face only of the connector housing and mating connector and are in mutually restrictive locations to preclude the improper positioning of the connector housing 62 and connector 10 with respect to the mating connector 14. As a result, it is impossible to couple the connector 10 and mating connector 14 in a reverse orientation.

In the normal mode of operation, every other connector wire 20 of the flat cable 12 is a ground for being received by the ground bus 72. Every intermediate connector wire 22 and 24 of the cable is adapted to carry a signal from the cable to the printed circuit board. As such, every signal wire of the cable must be bent outwardly toward an appropriate signal contact 60 on one side or the other of the longitudinal central plane. In this manner, appropriate wires of the flat cable may be coupled with appropriate traces of the printed circuit board for accommodating and effecting the intended electronic function of the connector.

The housing, with its signal contact connector wires of the cable in proper position, may then be heated as through radio frequency energy to liquify the solder material between the signal contacts and signal wires to make secure solder connections therebetween.

As particularly seen in FIGS. 3, 4A, 4B and 7, the signal connector wires of the cable are bent from the vertical orientation slightly less than a full 90 degrees. By bending them at about 70 degrees, their exterior portions remote from the bends will contact an exterior portion of the signal contacts, the edges of the signal contacts remote from the longitudinal central plane. When urged downwardly during coupling, the ends of the signal wires will be forced slightly upwardly by the signal contact to beyond the desired 70 degrees for insuring complete contact between all of the signal wires and their signal contacts. The deflection upwardly may be between about an additional 5 and 20 degrees, but still preferably below the horizontal or 90 degree orientation. This deflection of the wire insures a secure physical contact between each signal wire and its associated signal contact prior to soldering.

The diameter of the U-shaped slot 102 of the signal contacts 60 is equal to or preferably slightly greater than the diameter of the conductive signal wires 22 and 24 of the flat cable 12. The soldering may thus effect an encapsulation of at least about 270 degrees of the wires, for forming a mechanical bond as well as an electrical coupling. In practice, the solder material will often totally encapsulate the entire cross-section of the signal wires along their entire lengths. Contrary to previous thoughts, a mechanical wedging action between the wire and slot to be soldered has been found to be unnecessary, and hence the diameter or the wire 22 or 24 is preferably not greater than the width of the slot or the diameter of its bight.

In the preferred embodiment, the solder material may be applied to the appropriate portion or portions of the signal contacts by any one of a plurality of techniques including plating, printing, silkscreening, dipping or inlaying. In the preferred embodiment, the solder material is plated onto the upper end of the signal contact to at least cover the U-shaped bight. The soldering may be enhanced by a commercial flux material provided onto the stripped wire ends. The solder may be caused to reflow by any one of a plurality of methods of heating, including radio frequency, resistance, laser or vapor phase. Radio frequency is the preferred embodiment.

As will be understood by one skilled in the art, the coupling of the stripped wire ends to the signal contacts is effected by adhesion between the soldering material intermediate the wires and the signal contacts, the reflowing of the soldering material therebetween effecting the coupling. It should be further understood that the desired coupling may be effected by a wide range of adhesive coupling techniques.

The present disclosure includes that information contained in the appended claims as well as that in the foregoing description. Although the invention has been described in its preferred forms or embodiments with a certain degree of particularity, it is understood that the present disclosure of the preferred form has been made only by way of example and that numerous changes in the details of construction, fabrication and use, including the combination and arrangement of parts and method steps, may be resorted to without departing from the spirit and scope of the invention.

We claim:

1. An electrical connector assembly comprising an electrical connector and a multiconductor cable having a plurality of individual wires, the connector comprising:

an insulative housing having a plurality of apertures extending between a first surface and a second surface;

conductor termination means including a plurality of contact terminals located in the apertures, each contact terminal having means for receiving a wire at one end proximate the first surface;

strain relief means for holding the cable to preclude movement thereof from the connector;

the connector being characterized in that the strain relief means is oriented to position the cable parallel with a longitudinal central plane of the connector, at least the one end of the contact terminals also extending parallel to the longitudinal central plane of the connector with the means for receiving a wire in each contact terminal oriented to extend transversely to the longitudinal central plane of the connector, the individual wires being bent transversely relative to the longitudinal central plane of the connector and received in the means for receiving a wire in each contact terminal.

2. The electrical connector assembly of claim 1 wherein the means for receiving a wire at one end of each contact terminal comprises a U-shaped slot in the upper end of each contact terminal.

3. The electrical connector assembly of claim 2 wherein each U-shaped slot has a bight having a first diameter, each wire having a second diameter less than the first diameter, each contact terminal having solder predisposed thereon proximate the slot whereby each wire is bent by less than 90 degrees relative to the cable with the bent portion of each wire contacting the bight, and whereby the solder predisposed on each contact terminal can be reflowed to establish an electrical connection between each wire and a corresponding contact terminal.

4. The electrical connector assembly of claim 2 wherein the strain relief means are located on cover means assembleable to the insulative housing with the cable previously secured to the cover means, the ends of wires comprising signal wires being bent transversely relative to the cable, the ends of other wires comprising ground wires remaining in the plane of the cable; the conductor termination means including a ground bus in addition to the contact terminals, the contact terminals and the ground bus being positioned side by side in the insulative housing.

5. The electrical connector assembly of claim 4 wherein the ground bus is located in a central slot in the insulative housing, the ground bus having crimping sections at the upper end thereof for establishing mechanical and electrical contact with the ground wires.

6. The electrical connector assembly of claim 5 wherein the ground bus comprises a blade-like member having a U-shaped configuration with the free edges thereof flared for receipt of ground wires, the flared sections comprising the crimping sections.

7. The electrical connector assembly of claim 1 wherein the cable includes ground wires and signal wires and the conductor termination means of connector includes signal contact terminals and a ground bus, the ground wires being crimped to the ground bus and the signal wires being soldered to the signal contact terminals.

8. The electrical connector assembly of claims 1, 2, 3, 4, 5, or 6 wherein the multiconductor cable comprises a flat signal transmission cable having ground wires and signal wires embedded within a common insulative material, adjacent wires being closely spaced, the conductor termination means of the connector including a ground bus in addition to the contact terminals, the ground bus and the contact terminals in the connector being positioned so that the characteristic impedance of the connector is substantially equal to the characteristic impedance of the multiconductor transmission cable.

9. The electrical connector assembly of claims 1, 2, 3, 4, 5, or 6 wherein the apertures in the insulative housing are located in two parallel rows.

10. The electrical connector assembly of claims 1, 2, 3, 4, 5, or 6 wherein the conductor termination means includes a ground bus which is at least initially shiftable relative to the contact terminals, movement of the ground bus relative to the contact terminals being accompanied by movement of bent portions of wires into the means for receiving a wire at one end of each contact terminal.

11. An electrical connector assembly comprising an electrical connector and a multiconductor cable having a plurality of signal wires and ground wires, the connector comprising:

an insulative housing having a plurality of apertures extending between a first surface and a second surface;

a plurality of contact terminals located in the apertures, each contact terminal having means for receiving a signal wire at one end proximate the first surface;

a ground bus shiftable within a slot in the housing from a first position to a second position, the ground bus having means for receiving a plurality of ground wires in the multiconductor cable, each signal wire being proximate to the means on the contact terminals for receiving a signal wire, only when the ground bus is in the second position.

12. A connector adapted to couple stripped electrically conductive wires of a flat cable with the traces of a printed circuit board through a mating connector upstanding from the printed circuit board comprising in combination:

a housing formed with a longitudinal central slot, said slot adapted to receive an elongated electrically conductive ground bus the upper end of which is adapted to receive stripped ground wires of the flat cable and the lower end of which is adapted to be received within the mating connector, said housing having a longitudinal central plane extending through said slot and the bus, a plurality of parallel apertures formed in the housing on opposite sides of the central slot, said apertures adapted to receive signal contact the upper ends of which are adapted to receive stripped signal wires of the flat cable and the lower ends of which are adapted to be received within the mating connector, said housing having downwardly extending legs defining an opening for receiving the mating connector, and front and rear cover halves couplable between the housing and the printed circuit board and adapted to receive and support therebetween the flat cable above its stripped wires.

13. The connector as set forth in claim 12 wherein each said cover half includes a downwardly projecting first leg with a horizontal, upwardly facing ledge and said connector further includes a pair of side latches couplable with the printed circuit board, each said side latch having an upwardly projecting leg with a horizontal, downwardly facing ledge for receiving one said upwardly facing ledge of said cover halves for coupling said cover halves and said housing with respect to said side latches and the printed circuit board.

14. The connector as set forth in claim 13 wherein each said cover half has a downwardly projecting second leg, said second legs being located on opposite sides of the longitudinal central plane of said connector and interiorly of said first legs with each said second leg having a lower surface positionable upon an internal upper surface of said housing.

15. The connector as set forth in claim 14 and further including a space between each said first leg and its adjacent said second leg to allow each said first leg to be moved interiorly toward said second legs for the coupling an uncoupling of said cover halves and said housing with respect to said side latches and printed circuit board.

16. The connector as set forth in claim 15 wherein said housing has cutout portions on its front and rear faces and an external upper surface for the receipt of said cover halves.

17. The connector as set forth in claim 16 wherein the lower extents of each said second leg have face projections extending longitudinally toward the ends of said housing receivable in corresponding face recesses in said housing to preclude upward movement of said cover halves when positioned within said housing.

18. The connector as set forth in claim 16 wherein the ends of each said cover half have end projections extending longitudinally toward the ends of said housing receivable in corresponding end recesses in said housing to preclude lateral movement of said cover halves when positioned within said housing.

19. The connector as set forth in claim 12 and further including internal recesses in said cover halves facing the longitudinal central plane of said connector for receiving the upper portions of the signal contacts and the ground bus as well as the stripped wires of the flat cable.

20. The connector as set forth in claim 13 and further including means associated with said side latches to couple said side latches to a printed circuit board.

21. The connector as set forth in claim 20 wherein said last mentioned means includes a button downwardly extending from each said side latch, each said button having a cutout to facilitate its contraction and expansion and consequently, its insertion into, its retention in, and its removal from, a hole in a printed circuit board.

22. A method of assembling a multiconductor cable having signal wires and ground wires to an electrical connector having signal contacts with solder predisposed thereon and a ground bus comprising the steps of:

stripping insulation from the free ends of the wires;

bending the free ends of each signal wire out of the plane of the cable;

crimping the free ends of each ground wire to the ground bus;

shifting the ground bus relative to the signal contacts to bring the free ends of the cable into slots in the signal contacts; and reflowing the solder predisposed on the signal contacts to electrically connect the signal wires to the signal contacts.

* * * * *